United States Patent [19]

Khawand

[11] 4,006,902

[45] Feb. 8, 1977

[54] AMUSEMENT DEVICE WITH A BUBBLE MOVABLE IN A LIQUID HAVING MEANS FOR CONTROLLING THE SIZE AND MOVEMENT OF THE BUBBLE

[75] Inventor: Antoine B. Khawand, New York, N.Y.

[73] Assignee: Dynavision Corporation, New York, N.Y.

[22] Filed: Mar. 19, 1975

[21] Appl. No.: 559,909

Related U.S. Application Data

[63] Continuation-in-part of Ser. No. 495,682, Aug. 8, 1974, abandoned.

[52] U.S. Cl. ..... 273/113; 273/1 L

[51] Int. Cl.[2] ..... A63F 7/04

[58] Field of Search ..... 272/19; 273/1 L, 109, 273/110, 113, 115; 40/106.21

[56] References Cited

UNITED STATES PATENTS

| | | | |
|---|---|---|---|
| 901,206 | 10/1908 | Storey | 273/113 |
| 2,589,757 | 3/1952 | Williams | 40/106.21 |
| 3,071,888 | 1/1963 | Knott | 40/106.21 |
| 3,228,689 | 1/1966 | Capelle | 273/115 |
| 3,309,088 | 3/1967 | Knott | 273/110 |
| 3,464,132 | 9/1969 | Matisse | 273/1 L |
| 3,564,740 | 2/1971 | Calfee | 40/106.21 |

*Primary Examiner*—Anton O. Oechsle
*Assistant Examiner*—Harry G. Strappello
*Attorney, Agent, or Firm*—Darby & Darby

[57] ABSTRACT

An amusement device comprising a container having a hollow space filled with a liquid having a bubble movable therein. The device includes a channel separate from said hollow space; for trapping a portion of the bubble so as to be able to control its size and in a preferred embodiment of the invention an arrangement to make the bubble move rapidly between two compartments formed in the hollow space.

12 Claims, 5 Drawing Figures

AMUSEMENT DEVICE WITH A BUBBLE MOVABLE IN A LIQUID HAVING MEANS FOR CONTROLLING THE SIZE AND MOVEMENT OF THE BUBBLE

RELATED APPLICATION

This application is a continuation-in-part of my prior copending application Ser. No. 495,682 filed Aug. 8, 1974 now abandoned for "Amusement and Other Devices Utilizing a Liquid and a Movable Substance Therein".

In my prior copending application Ser. No. 495,682, abandoned, a novel amusement device is provided which includes a container having a liquid therein. An object, for example, a bubble of air or of other suitable material, is located within the liquid. The device is provided with a maze or a pattern on an upper or lower plate, or a plate dividing the interior of the container into two compartments or a combination of several of the foregoing, through which the bubble is to be maneuvered. The devices of the aforesaid application provide games which are highly amusing to play as well as games which are challenging insofar as they require a high degree of mental and physical coordination.

In games of the foregoing type, it becomes desirable to control the size of the bubble which is to be moved within the liquid. By controlling the size of the bubble, the degree of difficulty of the game may be increased since, as one typical example, it is much easier to play a game with a larger bubble than with a smaller bubble, or vice versa, depending upon the particular configuration of the game.

In addition, due to the materials used in constructing the game the size of the bubble will sometimes increase due to leakage or migration of air through the container. Further in one of the embodiments of the games shown in the foregoing application, wherein the bubble was to be manipulated through one or more openings in a plate which divided the container into two compartments, the bubble sometimes became trapped in one of the compartments and/or it split up into a number of parts. In some cases it became rather time consuming, and not interesting insofar as playing the game is concerned, to reassemble the bubble into one component and/or to move it from one of the compartments to the other.

Accordingly, the subject application relates to an improvement in the games of the aforesaid copending application in which an arrangement is provided for trapping a selected portion of the bubble in an auxiliary part of the game. In another embodiment of the invention a form of trap is provided to enable a number of parts of a dispersed bubble to be quickly reassembled and/or moved rapidly from one compartment to another.

It is therefore an object of the present invention to provide a novel amusement device having a bubble movable in a liquid in which means are provided to trap a portion of the bubble to control its size.

A further object is to provide a amusement device using a bubble moving in a liquid in a container which is divided into two compartments by a separator having openings in the separator in which a collector is provided to rapidly reassemble a bubble which has been split into a number of parts and to move the bubble from one compartment to the other.

A further object is to provide a novel amusement device having a bubble movable in a liquid which includes a means for trapping a part of the bubble to control its size and also to move the bubble rapidly through a separator member.

Other objects and advantages of the present invention will become more apparent upon reference to the following specification and annexed drawings, in which.

Figure 1:
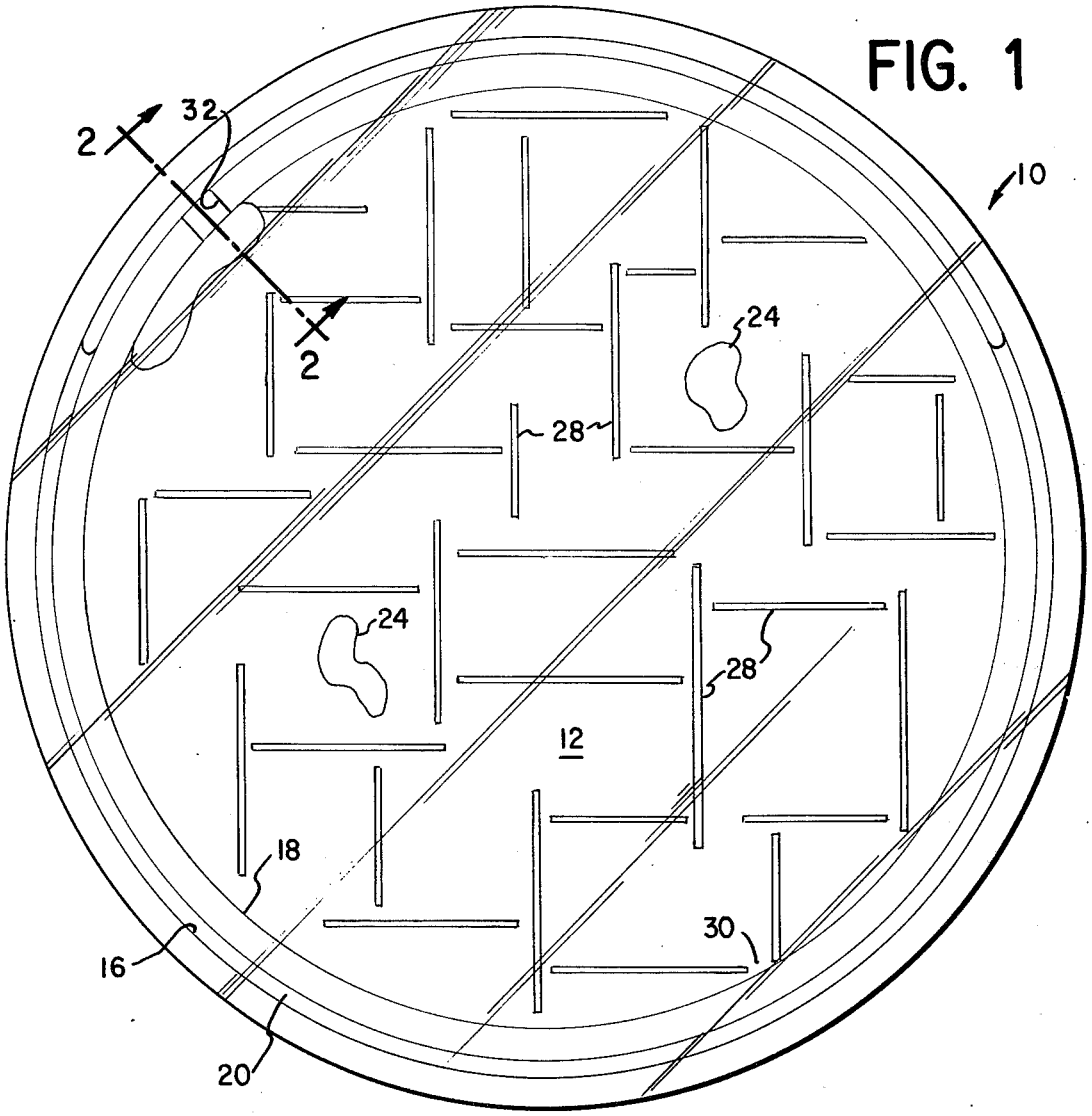
FIG. 1 is a plan view of an amusement device according to one embodiment of the invention.
Figure 2:
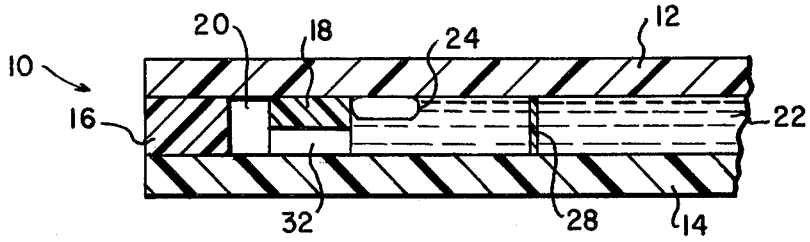
FIG. 2 is a fragmentary cross-section taken along the lines 2—2 of FIG. 1 showing the bubble trap.
Figure 3:
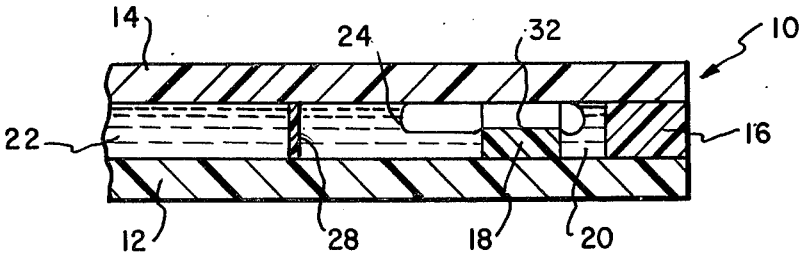
FIG. 3 is the same cross-section as FIG. 2 which the device inverted.

Referring first to FIGS. 1–3 of the drawings, an amusement device according to the invention includes a container 10 formed by upper and lower circular plates 12 and 14. It should be understood, of course, that the container can be of any desired shape, e.g., square, rectangular, triangular or any other desired shape. The plates are preferably of a transparent material, such as plastic or glass, which are joined together around the outer edges thereof by a continuous ring 16 which is also preferably of transparent material compatible with the material of the plates. Any suitable technique can be used to seal ring 16 to the plates 12 and 14, for example, by an adhesive or by heat sealing. The sealing technique depends upon the type of material and liquid. A second ring 18 is spaced inwardly from the container's periphery and is also sealed thereto. A trapping passage 20 is formed between the two rings 16 and 18. The details of the trapping passage are described below.

A playing area is provided in the central space of the container, that is, within the area bounded by the inner ring 18. A liquid 22 of a suitable type, substantially fills the playing area. Suitable liquids are disclosed in the aforesaid copending application and include alcohol. The trapping channel 20 is at least partially filled with the liquid 22. At least one bubble 24 is provided in the playing area. The bubble can be air or any other suitable liquid which is immersible with the liquid 22. The bubble can either coalesce to one integral unit or can be in several parts. The latter makes the degree of skill needed to play the game even more difficult.

In one form of the amusement device, a maze is provided in the playing area. As shown best in FIG. 1, the maze includes a plurality of walls 28 arranged in a predetermined pattern leaving spaces 30. The game is played by tilting the container in a manner such that the bubble, or bubble parts 24 are moved to pass between the various openings or in any other predetermined path. As also disclosed in the aforesaid copending application, a number of variations of the device are possible. For example, the container can be mounted on a partially spherical surface to limit the movement of the container, patterns can be placed on the upper or lower plates, the mazes can extend only part way between the upper and lower faces of the plates 12 and 14, etc.

In some cases, it is desired to change the size of the bubble 24 to vary the playing action of the game. For example, a bubble of reduced size moves quickly within the container and has less of a tendency to break up. Also, in some cases, where the bubble is of air, the size of the bubble will increase due to migration of air through the top and bottom plates or through the seals for the rings 16 and 18.

In accordance with the invention, the size of the bubble can be controlled by the trapping passage 18. To do this, a communicating restricted passage way 32 is provided between the interior playing space of the container and the trapping passage 20. Passageway 32 is a partial cut through the inner ring 18, preferably half the height of the ring, and has a relatively small width, for example a few degrees of arc in the circular configuration shown.

The container is manipulated to control the size of the bubble. This is shown in FIGS. 2 and 3. In FIG. 2, the passage 32 is arranged so that at that point in time it is at the bottom of the container. In this case, the bubble 24, being lighter than the liquid 22, floats on top of the liquid and encounters the portion of the ring 18 left at the top of the restricted passageway 32. Therefore, a portion of the bubble cannot pass through passageway 32 into the trapping passage 20.

As shown in FIG. 3, when the container is turned over from the position shown in FIG. 2, the restricted passageway 32 is now at the top of the container and the bubble 24 can enter it. By tilting the container a portion of the bubble can be made to move from the central area through passageway 32 and into the trapping channel 20. In essence, the container is manipulated to place the bubble adjacent the passage 32 and, by further slight movement of the container, part of the bubble will pass through passageway 32 into the trapping channel 20. Looking at it another way, a part of the liquid in the channel 20 is exchanged for the bubble part moving into the channel. The tilting operation to transfer a part of the bubble into the channel 20 can be carried out as many times as needed to obtain the desired size. Alternately, the size of the bubble in the playing area can be increased by reversing the tilting process.

It should be understood that the trapping channel need not surround the central area. It can be located only partway around the central area, or else, a separate area or reservoir of desired shape can be used. Thus, as should be apparent, the term channel is used in the broad sense in the specification and claims.

Figure 4:
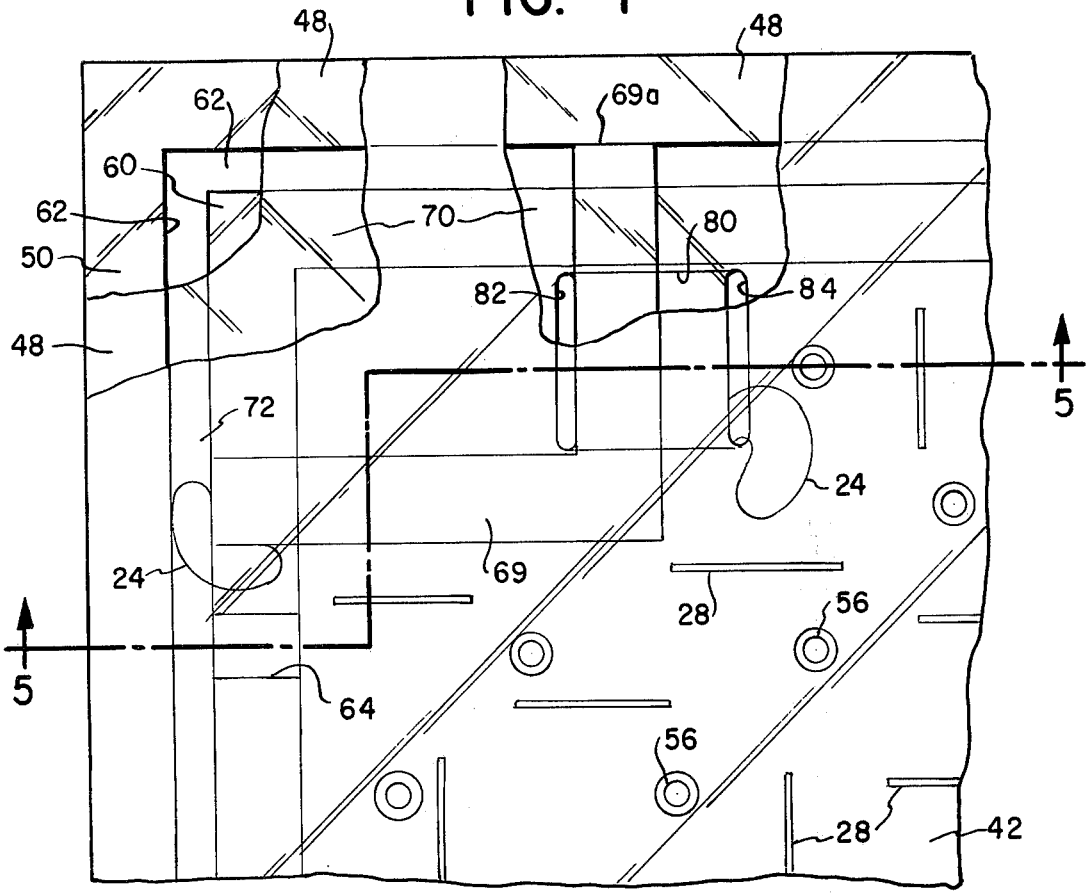
FIG. 4 is a fragmentary plan view of a further embodiment of the invention.
Figure 5:
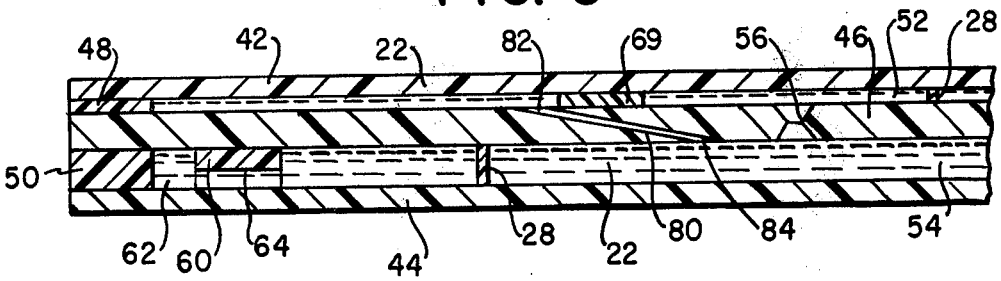
FIG. 5 is a cross-section of the embodiment of FIG. 4 taken along the lines 5—5 of FIG. 4.

FIGS. 4 and 5 show a further embodiment of the invention. Here, the device is of generally square or rectangular shape and includes upper and lower plates 42 and 44 and an internal divider plate 46. All three plates are preferably transparent.

The three plates are sealed at their outer peripheries by upper and lower rings 48 and 50. This forms upper and lower compartments 52 and 54 which are each filled with the liquid 22 and through which the bubble 24 can be manipulated.

The divider plate 46 is formed with a number of openings 56 through which the bubble can pass from one compartment to the other. The openings 56 are of tapered shape, going from a wider section on each face of plate 46 to a narrower section at the center of the plate. Two truncated conical sections placed end to end are shown. The tapered hole shape makes it easier for the bubble, or a part thereof, to overcome surface tension effects and pass through plate 46. When the holes are circular, the bubble has a tendency to stick or to break and leave a portion behind as it passes through the hole.

An inner ring 60 is provided in the lower compartment 54 between plates 44 and 46 and spaced inwardly from the outer ring 50 to form a trapping channel 62. A restricted passageway 64 is cut in the inner ring 60 to provide communication between the lower compartment 54 and the trapping channel 62. The purpose of channel 62 is the same as that previously described with respect to channel 20 of FIG. 1. That is, by tilting the container the size of the bubble can be controlled by trapping more or less of it in channel 62.

A maze 28 can be provided in one or both of the compartments 52 and 54. To utilize the game of FIGS. 3 and 4, the container is manipulated to move the bubble, or parts of it, through the maze and also through the openings. That is, one object of the game can be to pass all parts of the bubble from one compartment to the other. The maze need not be used.

In the amusement device of FIGS. 4 and 5 the bubble sometimes breaks into a number of separated parts while being passed into the upper compartment. These parts are normally quite difficult to quickly reassemble into a complete bubble. Further, in order to play the game wherein the bubble is to be moved from the lower to the upper compartment it becomes necessary to first put the bubble in the lower compartment. FIGS. 4 and 5 show an arrangement for both reassembling the bubble and moving it from the upper to the lower compartment.

An L-shaped wall 69 which engages ring 48 at one end 69*a* forms an assembly area 70 of generally rectangular shape. An opening 72 (FIG. 4) in the wall 69 provides an entranceway from the upper compartment 52 into the assembly area 70. Opening 72 is located only in the upper compartment and, while it is illustratively shown as being as wide as the trapping channel 62, it can be narrower or wider.

An angled slot 80 (FIG. 5) is cut through the divider plate 46. Slot 80 has openings 82, 84 communicating respectively with the top and bottom compartments 52 and 54. Opening 82 is in the assembly area 70 which communicates with the fluid, and the bubble in the upper compartment 46 through the opening 72.

To utilize the assembly area, the device is tilted so that the bubble, or bubble sections pass through opening 72 into the assembly area 70. This will normally entail tilting the device about two of its three axes. After the bubble, or sections, are collected in area 70, the device is tilted about its third axis and the bubble passes into slot opening 82, through angled slot 80 and out opening 84 into the bottom compartment 54. The angle of slot 80 makes the bubble travel relatively quickly and separates it from sticking on either surface of the center plate 46. In this manner, an entire bubble, or a desired section can be rapidly transferred from upper compartment 52 to lower compartment 54. The size of the bubble in the lower compartment can be controlled by the trapping channel 62.

As should be apparent, the present invention provides novel improvements for bubble control size and movement in a movable bubble-fluid amusement device.

What is claimed is:

1. An amusement device comprising upper and lower plates and a side wall forming a closed container having a hollow space with a fluid therein, a bubble of material different from said fluid which moves therein, means forming a channel surrounding said hollow space of said closed container, said channel forming means including said side wall, and a passageway through said side wall for selectively admitting a part of the bubble from the hollow space into the channel for controlling the size of the bubble.

2. The device of claim 1 further comprising a separator plate in said hollow space between said upper and lower plates dividing said hollow space into upper and lower compartments, at least one opening in said separator plate providing communication for said bubble between the upper and lower compartments and a slot through said separator plate of larger area than a said opening providing further communication for said bubble between the upper and lower compartments.

3. The device of claim 2 wherein a said opening in the separator plate tapers inwardly from a wider to a narrower cross-section from the surface toward the center of the plate.

4. The device of claim 2 wherein said slot extends through said plate lying at an angle of less than 90°.

5. The device of claim 4 further comprising means partially surrounding the opening to the slot on the upper surface of the separator plate to provide an assembly area for the bubble in the upper compartment.

6. The device of claim 5 wherein there is a restricted opening in the means surrounding the opening to the slot on the upper surface of the separator plate.

7. An amusement device comprising upper and lower plates and a side wall defining a closed container having a hollow space with a fluid therein, a bubble of a material different from said fluid which moves therein, a separator plate in said hollow space across substantially its entire area dividing it into upper and lower compartments in which the bubble can move, at least one opening in said separator plate providing communication for said bubble between the upper and lower compartments and a slot through said separator plate of larger area than a said opening providing further communication for said bubble between the upper and lower compartments.

8. The device of claim 7 wherein a said opening in the separator plate tapers inwardly from a wider to a narrower cross-section from the surface toward the center of the plate.

9. The device of claim 7 wherein said slot extends through said plate lying at an angle less than 90°.

10. The device of claim 9 further comprising means partially surrounding the opening to the slot on the upper surface of the separator plate to provide an assembly area for the bubble in the upper compartment.

11. The device of claim 10 wherein there is a restricted opening in the means surrounding the opening to the slot on the upper surface of the separator plate to provide communication between the hollow space of the upper compartment and the assembly area.

12. An amusement device comprising upper and lower plates and a side wall defining a closed container having a hollow space with a fluid therein, a bubble of a material different from said fluid which moves therein, a separator plate in said hollow space dividing it into upper and lower compartments, at least one opening in said separator plate providing communication for said bubble between the upper and lower compartments, a said opening of said separator plate tapering inwardly from a wider to a narrower cross-section from each surface of the plate toward its center.

* * * * *